US005887902A

United States Patent [19]

Irwin et al.

[11] Patent Number: 5,887,902

[45] **Date of Patent: *Mar. 30, 1999**

[54] SINGLE-PIECE SANDWICH FRAME CLIPBOARD APPARATUS

[76] Inventors: Mark Allen Irwin; Craig Allen Hunter, both of P.O. Box 8096, Anaheim, Calif. 92812

[ * ] Notice: This patent issued on a continued prosecution application filed under 37 CFR 1.53(d), and is subject to the twenty year patent term provisions of 35 U.S.C. 154(a)(2).

[21] Appl. No.: 618,929

[22] Filed: Mar. 20, 1996

[51] Int. Cl.[6] ..... B42D 3/00

[52] U.S. Cl. ..... 281/45; 248/451

[58] Field of Search ..... 281/45, 42, 19.1, 281/15.1, 51; 248/452, 450, 451, 444.1, 441.1; 211/45; D19/88, 89; 24/67 PR, 67 R, 67.3, 67.5, 67.9, 67.15, 530, 545, 557; 40/1.5

[56] References Cited

U.S. PATENT DOCUMENTS

| | | | |
|---|---|---|---|
| D. 316,275 | 4/1991 | Davis et al. | D19/88 |
| 478,035 | 6/1892 | Thuge | 24/67.11 |
| 2,568,565 | 9/1951 | Slonneger | 281/45 |
| 2,618,086 | 11/1952 | Komorous | 40/1.5 |
| 3,848,547 | 11/1974 | Schaefer . | |
| 4,892,334 | 1/1990 | Sinclair . | |
| 5,046,760 | 9/1991 | Krepp . | |
| 5,116,012 | 5/1992 | Offenhauer et al. . | |
| 5,145,141 | 9/1992 | Hunter . | |
| 5,193,852 | 3/1993 | Bachmeyer . | |
| 5,308,034 | 5/1994 | Hunter . | |
| 5,324,076 | 6/1994 | Nieradka . | |

FOREIGN PATENT DOCUMENTS

| | | | |
|---|---|---|---|
| 2185411 | 7/1987 | United Kingdom | 281/51 |

OTHER PUBLICATIONS

Jacobs Gardner Office Supply Catalog, p. 1003, Item A Dec. 1990.

*Primary Examiner*—Willmon Fridie, Jr.
*Attorney, Agent, or Firm*—Fulwider Patton Lee & Utecht, LLP

[57] ABSTRACT

A clipboard apparatus comprising a single sheet of plastic folded over to form two planar surfaces which allow the insertion of reference material into the sandwiched area formed between the two planar surfaces of said folded plastic sheet so as to protect said reference material from surrounding adverse elements. The clipboard apparatus further includes a clip assembly, attached to the planar surface at or near the fold, for securing a piece of paper to the outside smooth surface of the clipboard for writing, or drawing, on the surface.

9 Claims, 2 Drawing Sheets

FIG. 1
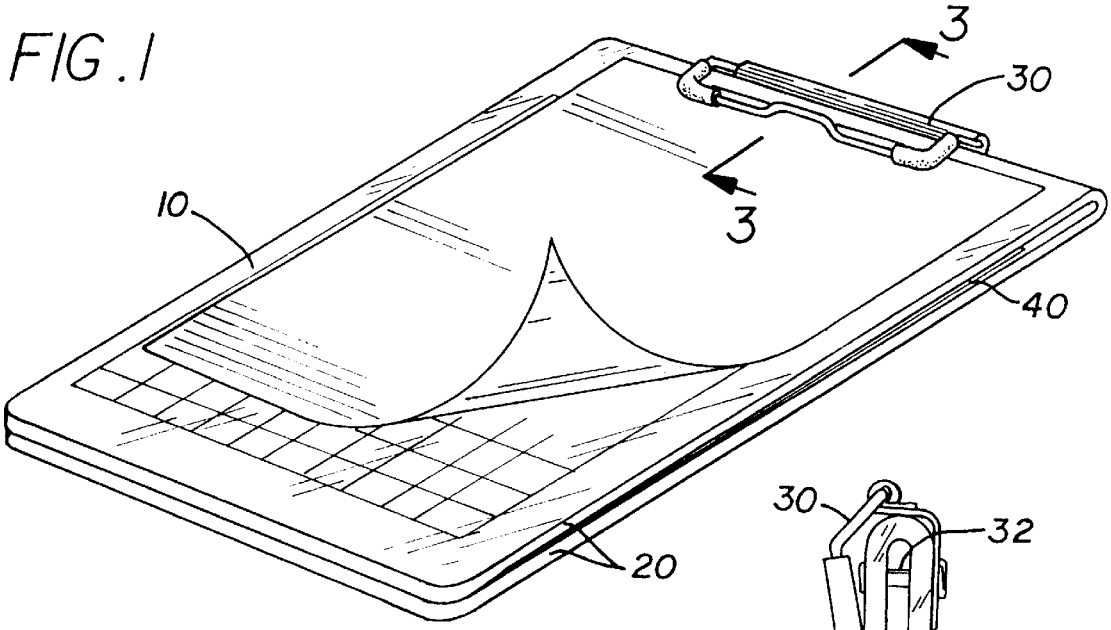
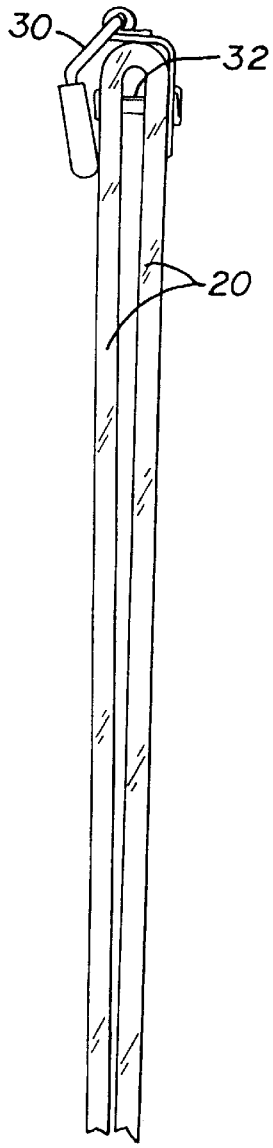
FIG. 2
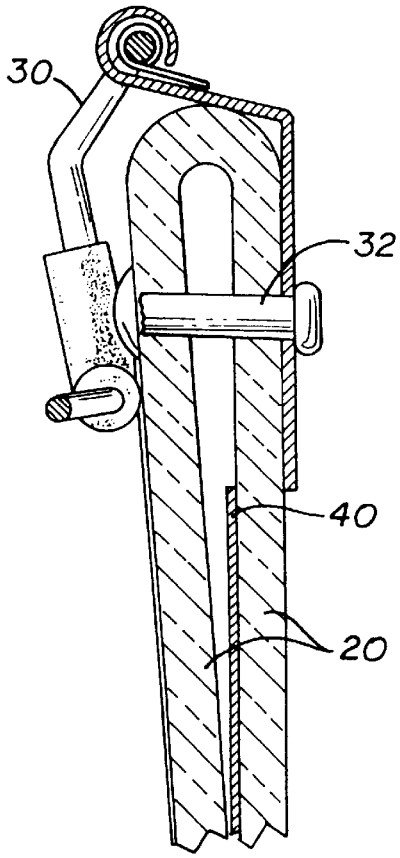
FIG. 3

SINGLE-PIECE SANDWICH FRAME CLIPBOARD APPARATUS

BACKGROUND OF THE INVENTION

1. Field of the Invention

This invention relates generally to clipboards and, more particularly to a clipboard having additional functions beyond providing a flat hard surface to write upon and a clip device to secure a piece of paper to said hard flat surface.

2. Description of Related Art

Clipboards, which provide a solid flat surface upon which writing or drawing can be performed and which incorporate a clip device to secure a piece of paper to said flat surface, have been known for many years. Many attempts have been set forth to expand the basic function of the clipboard to include such features as a storage drawer which slides out from the bottom area of the clipboard in which can be stored pencils, erasers and any small drawing or writing aids desired. Another advancement of the functionality of the clipboard is found in a design that incorporates slotted compartments machined into the lateral edges of the hard surface clipboard to accommodate drafting aids such as triangles, templates and squares. Innovation has even produced a clipboard tailored to police enforcement use which is transparent and bullet proof so that it can be held in front of the police officer as added protecting while, as an example writing a ticket. That particular clipboard design further encompasses a handle cut into one side of the hard surface so that the clipboard can further be used as a defensive weapon. Still another clipboard design incorporates a lamp assembly, digital clock, and storage area.

Often, however, a clipboard is required that will allow the user to protect a piece of paper, such as a map, a form sheet, or other pertinent data from the harsh environment in which the user is operating while at the same time allowing the user to view the protected document and make notations upon a separate piece of paper held on the hard surface by a clip device. One attempt at solving this need can be found in a clipboard that incorporates a first and a second panel member positioned one atop the other which are screwed together and at least one of the surfaces is transparent so as to allow viewing of a piece of paper held between the two surfaces. There exist three inherent problems with the aforementioned clipboard design. First—the design incorporates two pieces of hard surface material that must be machined separately and screwed together. Secondly—the two surfaces must be unscrewed to allow insertion of a piece of paper for viewing and protection, and then the screws must be re tightened to secure the piece of paper. Thirdly—since the clipboard involves two sheets of hard surfaces that are screwed together at the top of the clipboard, maximum pressure between the two sheets will exist at the top of the clipboard and minimum pressure will exerted, on the paper inserted, at the bottom of the clipboard. When the clipboard is held upright, there may not be sufficient pressure on the "captive" paper to hold it between the two surfaces.

It will be appreciated then that there exists a need for a clipboard that allows viewing of at least one piece of paper, while protecting that piece of paper from hostile elements, that can be economically and easily manufactured and that requires no tools, or disassembly, to use.

SUMMARY OF THE INVENTION

Briefly, and in general terms, the present invention provides for a clipboard apparatus that encompasses all the attributes of a standard clipboard while including the added features of protecting at least one piece of paper from hostile elements while allowing viewing of the paper through the transparent hard surface that embodies the clipboard foundation.

In a more detailed aspect of the invention the clipboard is constructed from a single piece of transparent plastic material which is folded in half to form a transparent, hard writing surface on the outside top and bottom surfaces which also provide a "sandwich space" between the two surfaces in which at least one piece of paper can be secured by the friction of the two hard surfaces. Furthermore, the surface material is folded over itself in such a manner as to guarantee maximum surface tension between the two sandwiched surfaces so that the inserted paper, or papers, will not dislodge, regardless of the position in which the clipboard is held. A clip assembly is attached at the folded end of the plastic surfaces. The clip assembly facilitates typical clipboard functions of allowing a piece of paper, or papers, to he held secure on the hard surface for writing or drawing on the paper.

In one preferred embodiment of the invention, the hard surface plastic material is acrylic and can be fluorescent to provide an appearance of it being lighted.

In another embodiment of the invention, the clipboard apparatus is not rectangular in shape, but rather any shape with one folded end and a plurality of open ends, including the embodiment of one folded end and a continuous open end about the circumference of the circular shaped hard plastic surface.

In each envisioned embodiment of the invention, the clip assembly is fastened to at least one of the hard plastic surfaces, at or about the folded end, with at least one fastener, which can be hardware such as rivets or screws, or glue.

Other aspects and advantages of the invention will become apparent from the following detailed description, taken in conjunction with the accompanying drawings, which illustrate, by way of example, the features of the invention.

BRIEF DESCRIPTION OF THE DRAWINGS

FIG. 1 is a perspective view of the clipboard apparatus embodying the invention in a condition in which it is ready to be utilized;

FIG. 2 is a plane side-view of the clipboard shown in FIG. 1;

FIG. 3 is an en larged cross-sectional view of the clip assembly mounted at the top of the clipboard taken on axis 3—3 in FIG. 1;

DETAILED DESCRIPTION OF THE PREFERRED EMBODIMENTS

Figure 4:
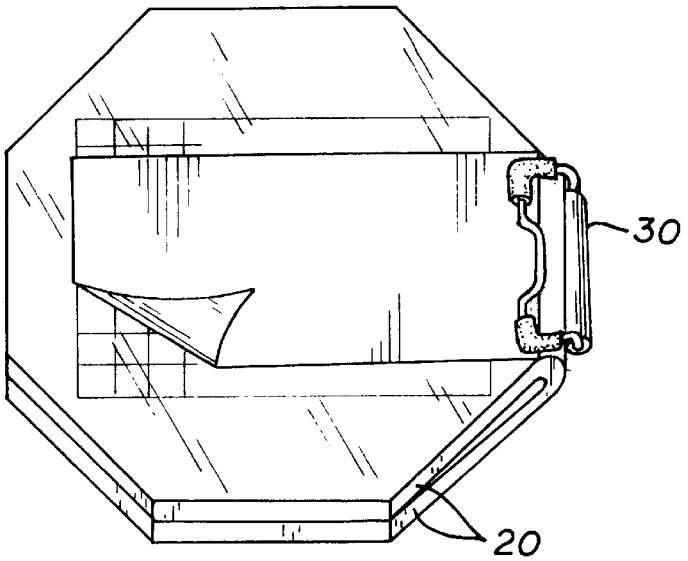
FIG. 4 is a plane view of one embodiment of the invention where the resulting clipboard apparatus is not rectangular in shape.

The clipboard apparatus 10, of the present invention, is illustrated in FIG. 1. The clipboard apparatus 10 includes a single plastic sheet folded over to form a sandwich-like space between the resulting two planar surfaces 20, and a clip assembly 30 attached at, or near, the folded end of the two planar surfaces 20.

The open ends of the planar surfaces 20 furthest from the folded end of the planar surfaces can be sprung apart to allow insertion of at least one sheet of paper 40 to be protected by the clipboard apparatus (such as a form, map, photograph, reference guide, etc.). The tension between the two planar surfaces 20 is sufficient to securely hold the inserted paper 40 when the clipboard apparatus is held in any orientation.

The clip assembly 30 is attached to the folded plastic sheet planar surfaces 20 at, or near, the folded end of the plastic sheet by any of several attachment methods, including hardware such as rivets or screws, glue, or heat fusing.

One embodiment of the invention is depicted in FIG. 3 wherein the clip assembly is attached to the two planar surfaces using a pair of rivets 32 which pass through two clearance holes in the planar surfaces slightly removed from the folded end of the plastic sheet. In this embodiment, the plastic sheet is transparent so that the paper inserted between the planar surfaces can be viewed from either planar surface.

In the embodiment depicted in FIGS. 1–3, the clipboard portrays a conventional rectangular shape with a size consistent with standard sizes of paper, e.g., letter, legal, A4, etc. Other embodiments of the clipboard apparatus can take on any shape, one of which is depicted in FIG. 4 where the resulting clipboard apparatus, after folding the single plastic sheet, forms an octagon.

Figure 5:
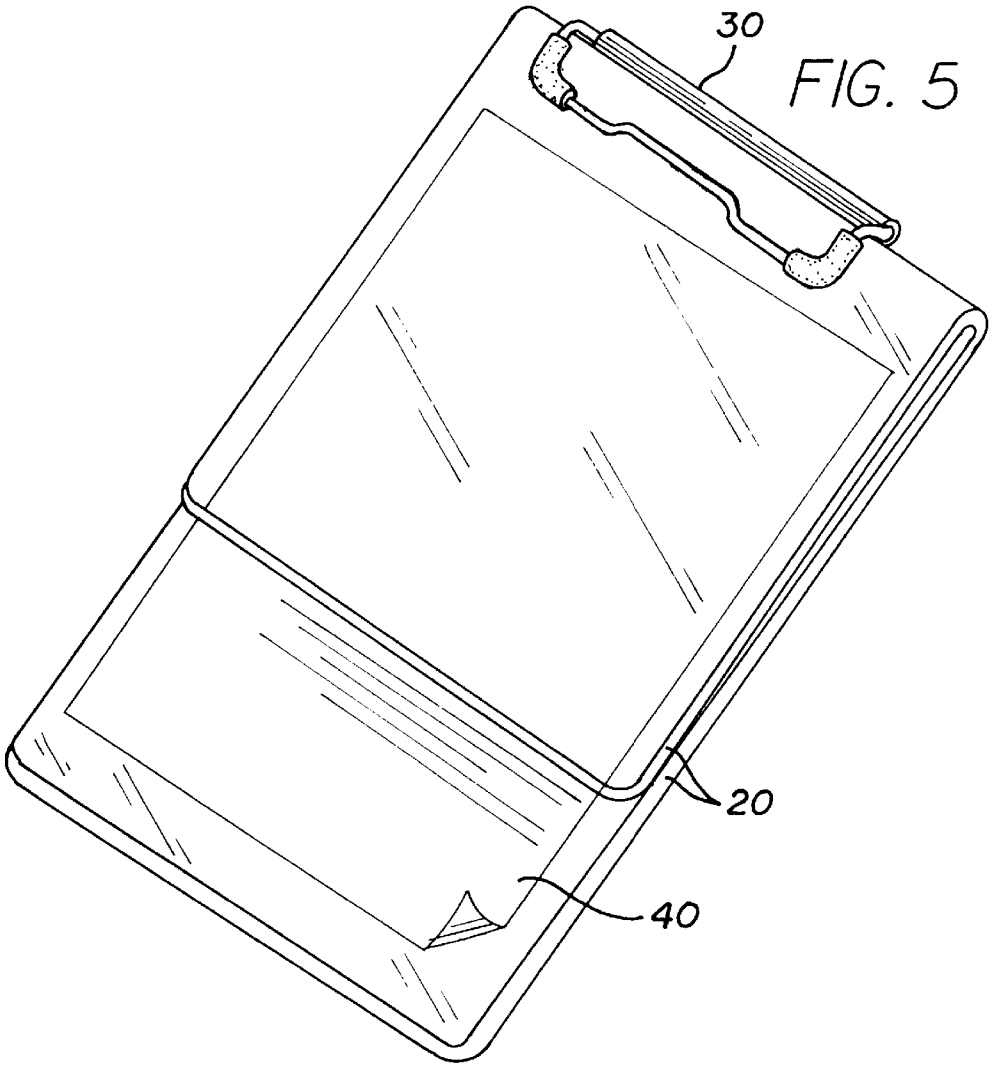
FIG. 5 is a plane view of one embodiment of the invention where at least one open end of the clipboard surface does not totally cover the "protected" sheet of paper.

In typical use, the clipboard will protect a piece of reference material such as a map or form and a sheet of paper can be clipped to the writing surface on which information can be entered by the user. There are envisioned embodiments of the invention where the single sheet of plastic is shaped or folded such that at least one open side of the clipboard apparatus has two planar surfaces,that do not form a single edge, as depicted in FIG. 5. Such a configuration would be useful to protect portions of a form held under the planar surfaces while allowing writing directly onto other areas of the "unprotected" portions of the form.

Although the present invention has been described in detail with reference to the presently-preferred embodiment, it should be understood that various modifications can be made without departing from the spirit and scope of the invention. Accordingly, the invention is limited only by the appended claims.

What is claimed is:

1. A clipboard apparatus comprising:

a single plastic sheet folded over to form first and second planar members joined together at a folded portion and permanently biased together, said first and second planar members each having upper and lower planar sides, said upper sides having an upper planar writing surface, said first and second planar members having one closed side at said folded portion and the remainder of said first and second planar members not being joined together, and said second planar member extending beyond said first planar member in at least one direction so as to expose a portion of said upper planar surface of said second planar member, each of said two upper planar sides thereby providing a smooth writing surface area; and a clip assembly attached adjacent to the folded portion of the planar members.

2. The clipboard assembly of claim 1, wherein said two planar members form a rectangle with one closed side and three open sides.

3. The clipboard apparatus of claim 1, wherein said single plastic sheet is a transparent polycarbonate plastic.

4. The clipboard apparatus of claim 3, wherein said transparent polycarbonate plastic is acrylic.

5. The clipboard apparatus of claim 1, wherein said clip assembly is attached to at least one of the planar surfaces by at least one fastener.

6. A method for providing a clipboard apparatus for protecting reference material therefor from the surrounding environments, comprising:

forming first and second transparent planar members by folding a single transparent plastic sheet to produce a folded portion of said first and second transparent planar members providing sufficient permanent compression between the planar member inner surfaces to secure the reference material inserted into a sandwich area created between the folded planar members, said first and second planar members each having upper and lower planar sides, said upper sides having a planar writing surface, and said first and second planar members having one closed side at said folded portion and the remainder of said peripheries of said first and second planar members not being joined together, and said second planar member extending beyond said first planar member in at least one direction so as to expose a portion of said upper planar surface of said second planar member, each of said two planar upper sides thereby providing a smooth writing surface area; and attaching a clip assembly adjacent the folded portion of the two planar members to accept, and hold in place, any material upon which the user wishes to write.

7. The method of claim 6, further including the step of attaching the clip assembly to a planar member with fasteners.

8. A clipboard apparatus comprising:

a rectangular sheet of transparent plastic folded to form a pair of essentially parallel planar members joined by a fold such that the fold permanently induces pressure between the planar members at their interface, the planar members being separable with pressure on the planar members so that a sheet of paper can be inserted between the planar members and held in place by the pressure between them, said planar members each having upper and lower planar sides, said upper sides having a planar surface, said planar members having one closed side at said folded portion and the remainder of said first and second planar members not being joined together, and said second planar member extending beyond said first planar member in at least one direction so as to expose a portion of said upper planar surface of said second planar member, each of said two upper planar sides thereby providing a smooth writing surface area; and a clip attached to one of said planar members to be used to hold a sheet of paper.

9. The clipboard of claim 8, wherein said clip is attached to said planar member by fasteners.

* * * * *